US006599146B2

(12) United States Patent
Liao

(10) Patent No.: US 6,599,146 B2
(45) Date of Patent: Jul. 29, 2003

(54) ZIF SOCKET

(75) Inventor: Fang-Chu Liao, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/956,069

(22) Filed: Sep. 18, 2001

(65) Prior Publication Data

US 2003/0045152 A1 Mar. 6, 2003

(30) Foreign Application Priority Data

Sep. 5, 2001 (TW) ..... 90215164

(51) Int. Cl.[7] ..... H01R 13/625
(52) U.S. Cl. ..... 439/342; 439/265
(58) Field of Search ..... 439/342, 259–270

(56) References Cited

U.S. PATENT DOCUMENTS 5,722,848 A * 3/1998 Lai et al. ..... 439/342
6,371,785 B1 * 4/2002 Howell et al. ..... 439/342
6,383,006 B1 * 5/2002 McHugh et al. ..... 439/342
6,419,514 B1 * 7/2002 Yu ..... 439/342

* cited by examiner

*Primary Examiner*—Hien Vu
(74) *Attorney, Agent, or Firm*—Wei Te Chung

(57) ABSTRACT

A ZIF socket (1) comprises a base (10), a sliding cover (20) and an actuating lever (30). The actuating lever is substantially L-shaped and includes a handle (34) and a driving arm (32) extending perpendicularly from a joining portion (35) of the handle. The driving arm comprises an elongate pivot (321), a cam portion (33) extending forwardly from the pivot and a large-dimensioned portion (36) formed at one end of the pivot proximate to the joining portion. The joining portion has enough strength for resisting breakage and damage. When an excessive force is exerted on the handle of the actuating lever, or even after repeated actuation of the actuating lever, the joining portion of the actuating lever will not be damaged. Thus, the actuating lever may have a longer life than the conventional design and makes the ZIF socket work more reliably.

5 Claims, 5 Drawing Sheets

ZIF SOCKET

BACKGROUND OF THE INVENTION

1. Field of the Invention

The present invention relates to a Zero Insertion Force (ZIF) socket, and particularly to a ZIF socket having an actuating lever with increased structural strength.

2. Description of Related Art

Referring to FIG. 5, a ZIF socket 6 of the conventional invention comprises a base 7, a sliding cover 8 and an actuating lever 9. The base 7 includes a rectangular body 71 and a mounting portion 72 at a rear end thereof. The body 71 comprises a plurality of through holes 73 for receiving contacts 60 of the ZIF socket 6. The body 71 also includes a pair of blocks 76 extending outwardly from top portions of opposite side walls 70 thereof and a support 75 extending outwardly from a bottom portion of a right side wall 70. The mounting portion 72 includes a first transverse receiving channel 721 and a concavity 722 in front of the receiving channel 721. A block 723 extends outwardly from a right end of the mounting portion 72 for preventing the actuating lever 9 from moving unduly. The sliding cover 8 comprises a rectangular cover frame 81 and a ledge 82 at a rear end thereof. The cover frame 81 includes a plurality of receiving holes 83 respectively corresponding to the through holes 73 for receiving corresponding pins of a mating integrated circuit chip (not shown). The ledge 82 includes a mounting section 821, and a second transverse receiving channel 822 in the middle of the mounting section 821. The actuating lever 9 is substantially L-shaped and includes a handle 91 and a driving arm 92 extending perpendicularly from a joining portion 93 of the handle 91.

In assembly, after the driving arm 92 is put in the first transverse receiving channel 721, the sliding cover 8 is placed on the base 7 and then pushed downward to engage with the base 7. The actuating lever 9 can pivotably rotate in the concavity 722 and the second transverse receiving channel 822 driving the sliding cover 8 to move longitudinally along the base 7, thereby moving pins of the corresponding chip into electrical connection with the contacts 60.

However, during pivotable rotation of the actuating lever 9 in the concavity 722, when an excessive force is exerted on the handle 91 of the actuating lever 9, or when the actuating lever 9 is subject to repeated actuations, the joining portion 93 of the actuating lever 9 is easy to be broken or damaged. This is because the strength of the joining portion 93 is not enough. As a result, the actuating lever 9 has a short life and makes the ZIF socket not work reliably.

Hence, an improved ZIF socket having an actuating lever with sufficient strength for handling is required to overcome the disadvantages of the conventional ZIF socket.

SUMMARY OF THE INVENTION

Accordingly, the object of the present invention is to provide a ZIF socket wherein its actuating lever has a joining portion with increased structural strength.

In order to achieve the object set forth, a ZIF socket of the present invention comprises a base, a sliding cover and an actuating lever. The base includes a rectangular body and a mounting portion at a rear end thereof. The sliding cover comprises a rectangular cover frame and a ledge at a rear end thereof. The actuating lever is substantially L-shaped and includes a handle and a driving arm extending perpendicularly from a joining portion of the handle. The driving arm comprises an elongate pivot received in lower receiving channel and a cam portion extending forwardly from the pivot. A large-dimensioned portion is formed at one end of the driving arm proximate to the handle. The joining portion comprises a first reinforcing section extending upwardly therefrom, a second reinforcing section extending downward thereof and a third reinforcing section formed at an inside of the handle and proximate to the first reinforcing section.

Other objects, advantages and novel features of the invention will become more apparent from the following detailed description when taken in conjunction with the accompanying drawings.

BRIEF DESCRIPTION OF THE DRAWINGS

FIG .4 is a fragmentary, plan view of the actuating lever of the ZIF socket in accordance with the present invention.

DETAILED DESCRIPTION OF THE INVENTION

Figure 1:
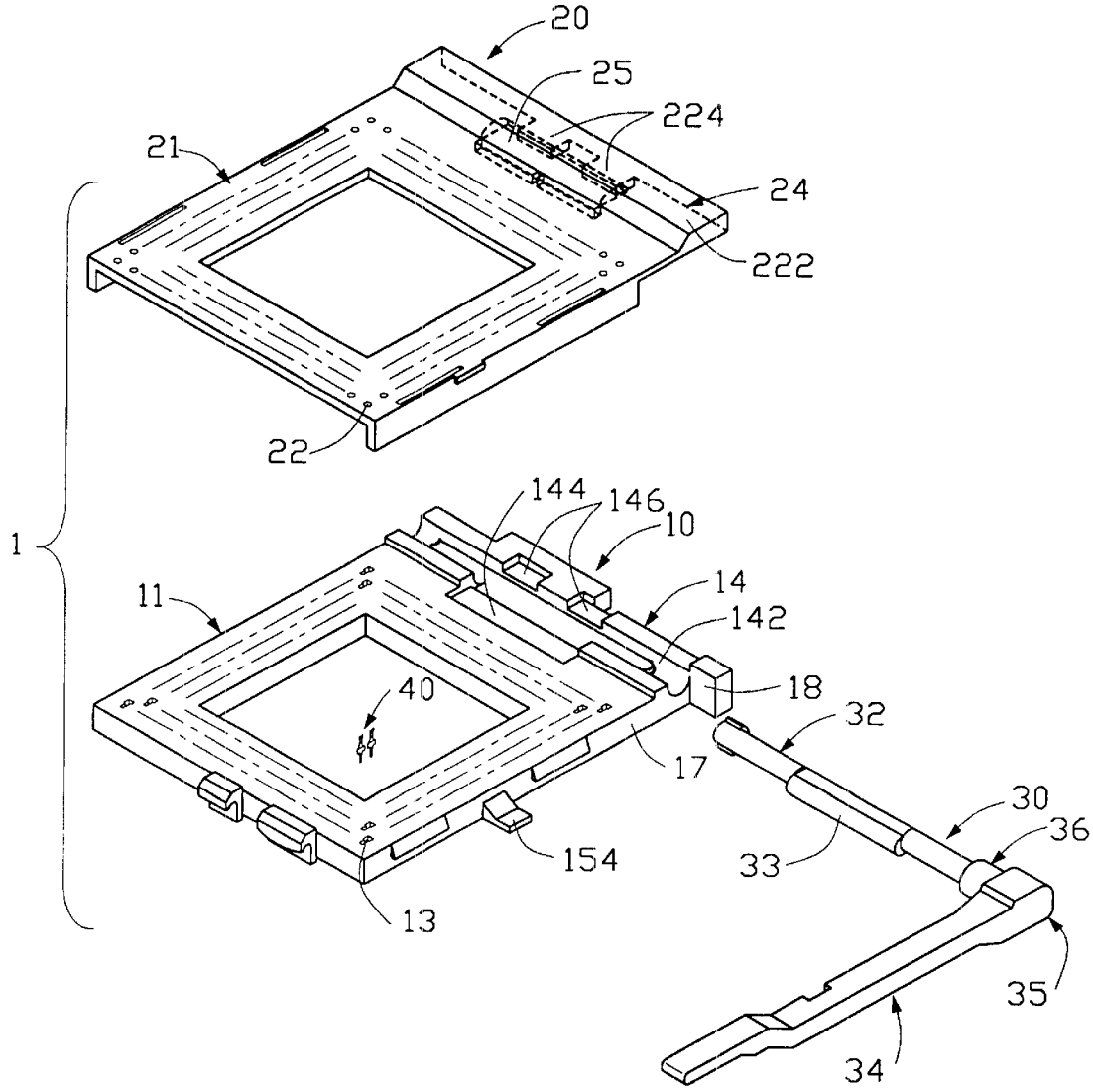
FIG. 1 is an exploded, perspective view of a ZIF socket in accordance with the present invention.

Reference will now be made to the drawing figures to describe the present invention in detail.

Referring to FIG. 1, a ZIF socket 1 of the present invention comprises a base 10, a sliding cover 20 and an actuating lever 30.

The base 10 includes a rectangular body 11 and a mounting portion 14 at a rear end thereof. The body 11 comprises a plurality of through holes 13 for receiving contacts 40 of the ZIF socket 1. The body 11 also includes a support 154 extending outwardly from a bottom portion of a right side wall 17. The mounting portion 14 includes a first transverse receiving channel 142, a concavity 144 in front of the receiving channel 142 and a pair of rectangular recesses 146 opposite to the concavity 144. A block 18 extends outwardly from a right end of the mounting portion 14 for preventing the actuating lever 30 from moving unduly.

The sliding cover 20 comprises a rectangular cover frame 21 and a ledge 24 at a rear end thereof. The cover frame 21 includes a plurality of receiving holes 22 respectively corresponding to the through holes 13 for receiving corresponding pins of a mating integrated circuit chip (not shown). The ledge 24 includes a mounting section 222, a second transverse receiving channel 25 in a middle of the mounting section 222 and a pair of protrusions 224 in the middle of the mounting section for being received in the recesses 146 of the mounting portion 14 of the base 10.

Figure 3:
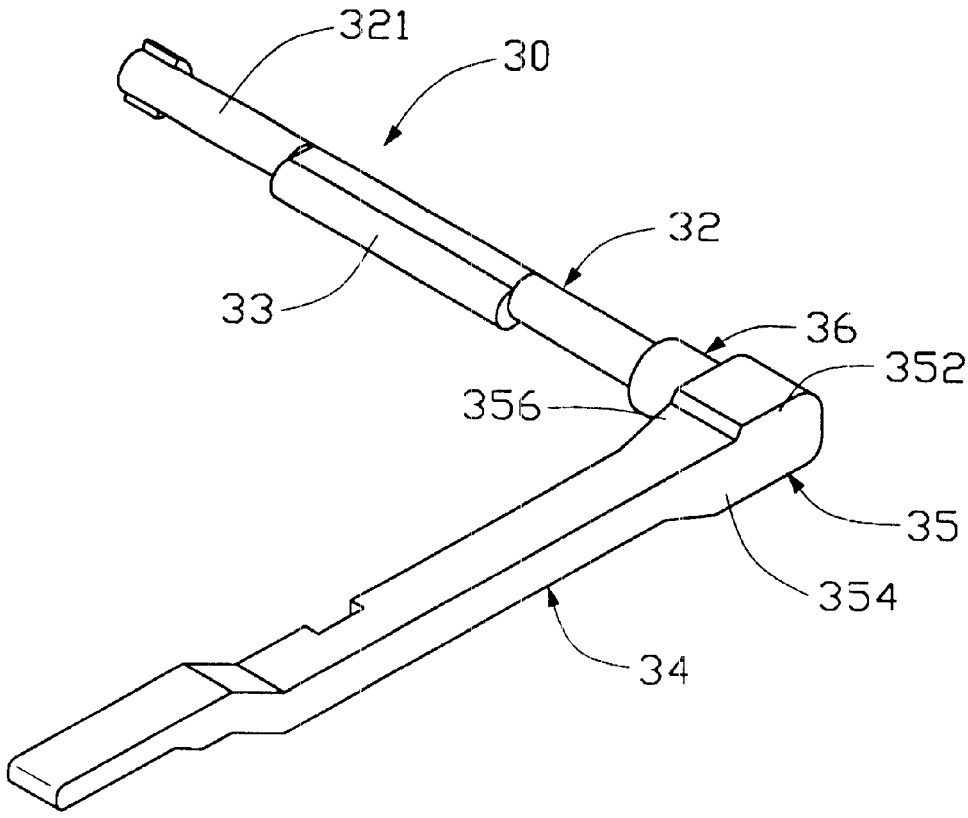
FIG. 3 is a perspective view of an actuating lever of the ZIF socket in accordance with the present invention.
Figure 4:
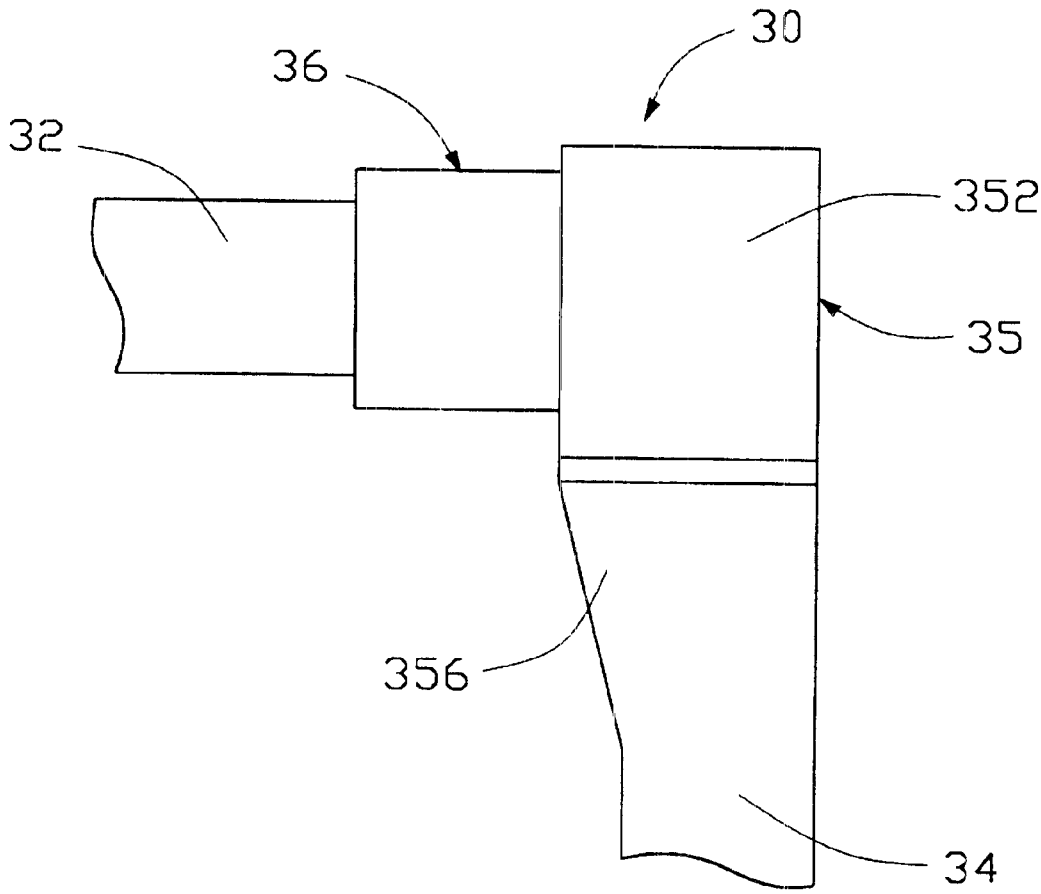
Figure 5:
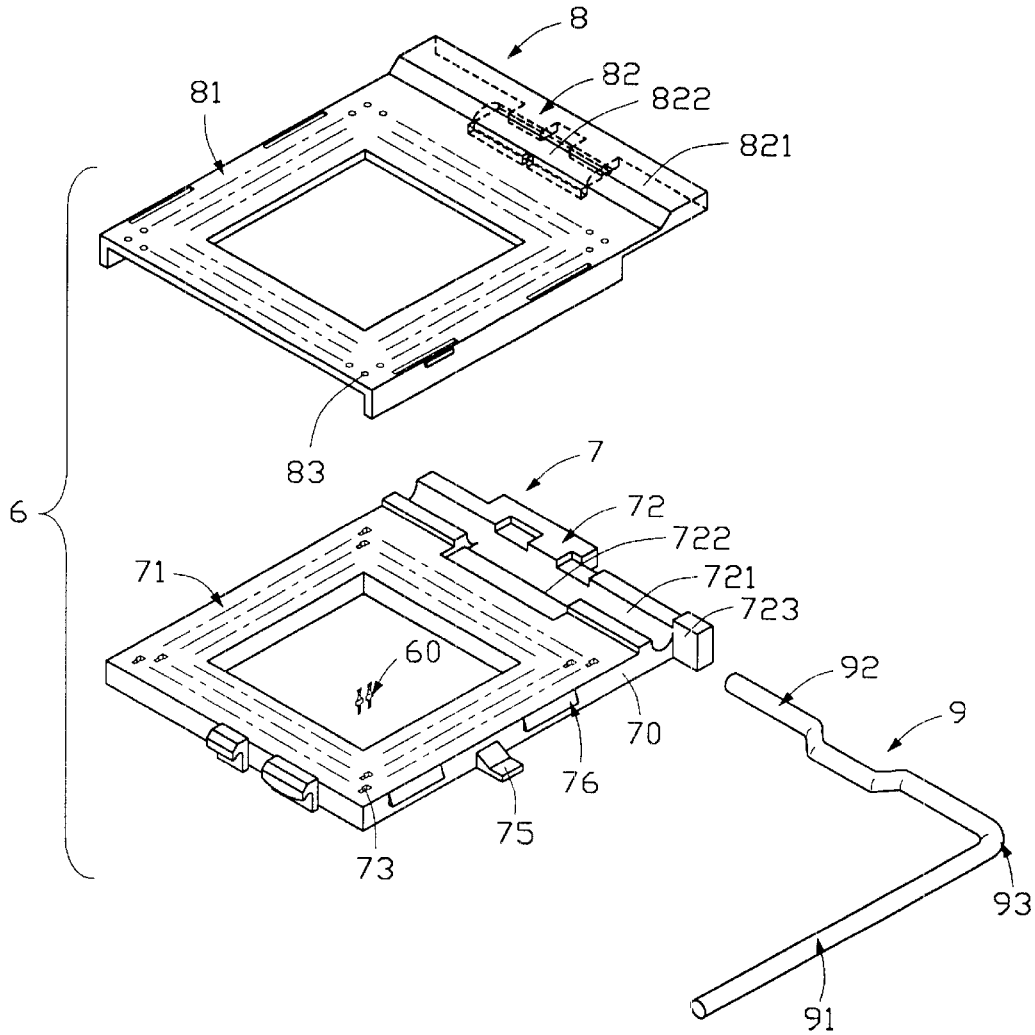
FIG. 5 (PRIOR ART)
FIG. 5 is an exploded, perspective view of a conventional ZIF socket.

Also referring to FIG. 3 and FIG. 4, the actuating lever 30 is substantially L-shaped and includes a handle 34 and a driving arm 32 extending perpendicularly from a joining portion 35 of the handle 34. The driving arm 32 comprises an elongate pivot 321 received in first receiving channel 142 and a cam portion 33 extending forwardly from the pivot 321. A large-dimensioned portion 36 is formed at one end of the pivot 321 proximate to the joining portion 35. The joining portion 35 comprises a first reinforcing section 352 extending upwardly therefrom, a second reinforcing section 354 extending downward therefrom and a third reinforcing section 356 formed at an inside of the handle 34 and proximate to the first reinforcing section 352. The three reinforcing sections of the joining portion 35 are larger in dimension than the remaining portion of the handle 34 to have increased structural strength for resisting breakage and damage. Similarly, the large-dimensioned portion 36 can enhance the strength of the driving arm 32.

Figure 2:
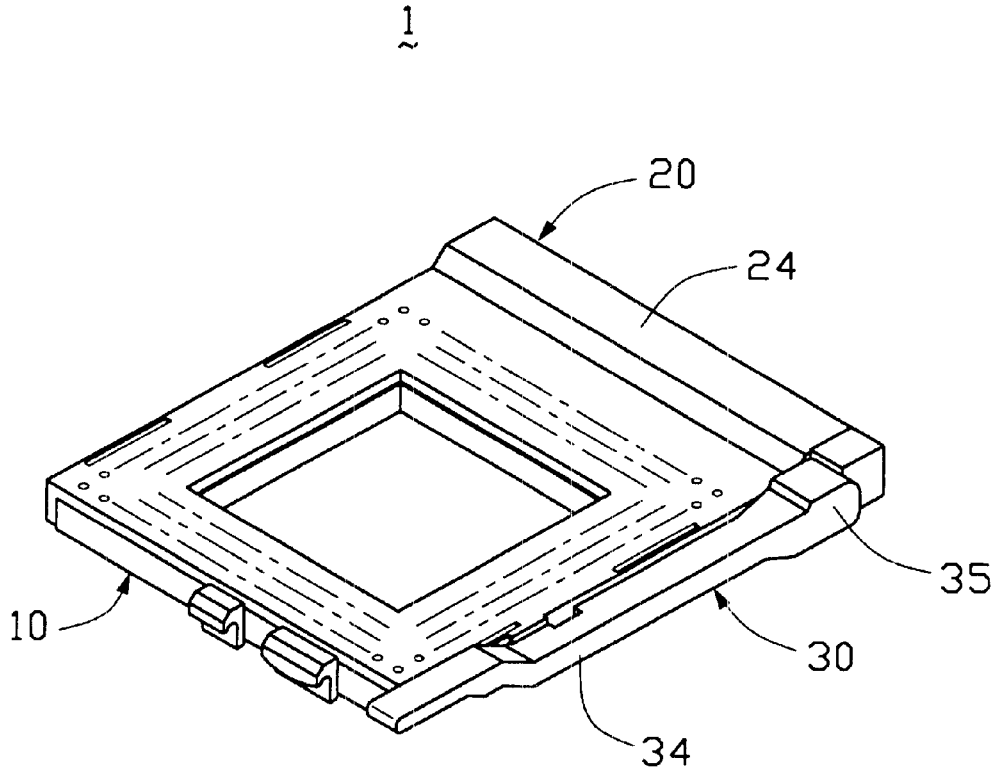
FIG. 2 is a perspective, assembled view of the ZIF socket in accordance with the present invention.

Also referring to FIG. 2, in assembly, after the driving arm 32 is put in the first transverse receiving channel 142 and the concavity 144, the sliding cover 20 is placed on the base 10 and then pushed down to engage with the base 10. The two protrusions 224 of the sliding cover 20 are received in the two recesses 146 of the base 10 and the cam portion 33 of the actuating lever 30 is received in the concavity 144 of the base 10. The actuating lever 30 can pivotably rotate in the concavity 144 about the axis of the pivot 321 and drive the sliding cover 20 to move longitudinally along the base 10, thereby moving pins of the corresponding chip into electrical connection with the contacts 40. The handle 34 is supported by the support 154. When an accidental, excessive force is exerted on the handle 34 of the actuating lever 30, the large-dimensioned portion 36 and the joining portion 35 can release the stress. Even after repeated actuation of the actuating lever 30, the joining portion 35 and the large dimensioned portion 36 of the actuating lever 30 will not be damaged because of sufficient strength. Thus, the actuating lever 30 may have a longer life than the conventional design and makes the ZIF socket work more reliably.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A Zero Insertion Force (ZIF) socket, comprising:

a plurality of contacts;

a base including a body and a mounting portion at a rear end thereof, the body comprising a plurality of through holes for receiving the contacts, the mounting portion comprising a first transverse receiving channel and a concavity:

a sliding cover being assembled on the base and comprising a cover frame and a ledge at a rear end thereof, the ledge comprising a second transverse receiving channel; and an actuating lever including a handle and a driving arm extending perpendicular to the handle, the handle comprising a joining portion, the driving arm comprising a pivot received in the first transverse receiving channel and a cam portion extending from the pivot, the cam portion being received in the concavity of the base and movable to drive the sliding cover to move longitudinally along the base, the joining portion comprising a first reinforcing section extending upwardly therefrom, a second reinforcing section extending downward therefrom and a third reinforcing section formed at an inside of the handle and proximate to the first reinforcing section; wherein the mounting portion includes a pair of rectangular recesses opposite to the concavity; wherein the ledge includes a mounting section and a pair of protrusions in the middle of the mounting section for being received in the recesses of the mounting portion of the base.

2. The ZIF socket as described in claim 1, wherein the actuating lever includes a large-dimensioned portion formed at one end of the pivot proximate to the joining portion.

3. The ZIF socket as described in claim 1, wherein the mounting portion includes a block extending outwardly from a right end thereof for preventing the actuating lever from moving unduly.

4. A ZIF (zero insertion force) socket comprising:

a base including a body and a mounting portion at a rear portion thereof, said mounting portion defining therein a concavity and a first channel along a transverse direction thereof;

a sliding cover assembled to the base and moveable relative the base in a front-to-back direction thereof, said cover comprising a cover frame and a ledge at a rear end thereof, the ledge comprising a second transverse receiving channel;

a plurality of contacts disposed in the base; and an actuating lever including a handle and a driving arm extending perpendicular to the handle and generally received within the first channel, a joining portion formed on a fixed rear end of said handle around said driving arm, wherein said joining portion is enlarged relative to the other portions of the handle in both a vertical direction and said transverse direction; wherein the mounting portion includes a pair of rectangular recesses opposite to the concavity; wherein the ledge includes a mounting section and a pair of protrusions in the middle of the mounting section for being received in the recesses of the mounting portion of the base.

5. The socket as described in claim 4, wherein a large-dimensioned portion is formed at a fixed end of the driving arm proximate said joining portion.

* * * * *